US007453450B2

(12) United States Patent
Sano et al.

(10) Patent No.: US 7,453,450 B2
(45) Date of Patent: Nov. 18, 2008

(54) DISPLAY APPARATUS

(75) Inventors: Yutaka Sano, Tottori (JP); Satoshi Morita, Tottori (JP)

(73) Assignees: Sanyo Electric Co., Ltd., Osaka (JP); Tottori Sanyo Electric Co., Ltd., Tottori (JP)

( * ) Notice: Subject to any disclaimer, the term of this patent is extended or adjusted under 35 U.S.C. 154(b) by 787 days.

(21) Appl. No.: 11/086,653

(22) Filed: Mar. 23, 2005

(65) Prior Publication Data

US 2005/0219236 A1 Oct. 6, 2005

(30) Foreign Application Priority Data

Mar. 30, 2004 (JP) ..... 2004-098901

(51) Int. Cl.
*G09G 5/00* (2006.01)

(52) U.S. Cl. ..... 345/204

(58) Field of Classification Search ..... 345/87, 345/94, 98, 100, 204, 211, 212; 349/151
See application file for complete search history.

(56) References Cited

U.S. PATENT DOCUMENTS

| | | | | |
|---|---|---|---|---|
| 6,211,849 | B1 * | 4/2001 | Sasaki et al. | 345/55 |
| 6,384,805 | B1 * | 5/2002 | Takada | 345/87 |
| 6,937,233 | B2 * | 8/2005 | Sakuma et al. | 345/211 |
| 6,982,706 | B1 * | 1/2006 | Doi et al. | 345/206 |
| 7,079,123 | B2 * | 7/2006 | Shino et al. | 345/204 |
| 7,126,597 | B2 * | 10/2006 | Shino et al. | 345/212 |
| 2003/0234760 | A1 * | 12/2003 | Lin et al. | 345/98 |
| 2004/0183985 | A1 * | 9/2004 | Taguchi | 349/151 |
| 2006/0012744 | A1 * | 1/2006 | Wang et al. | 349/151 |

FOREIGN PATENT DOCUMENTS

| | | | |
|---|---|---|---|
| JP | 62-238684 | | 10/1987 |
| JP | 2001-056481 | | 2/2001 |
| KR | 2005048834 | A * | 5/2005 |

* cited by examiner

*Primary Examiner*—Sumati Lefkowitz
*Assistant Examiner*—Rodney Amadiz
(74) *Attorney, Agent, or Firm*—Katten Muchin Rosenman LLP

(57) ABSTRACT

A liquid crystal display apparatus is constituted whereby multiple source driver circuits provided with a driver IC are connected to the periphery of a liquid crystal display panel, and power supply voltages supplied from the outside are sequentially supplied from a specific source driver circuit to an adjacent source driver circuit, and a wire resistance calculation wire is formed for the driver IC in the voltage supply direction upstream, and is approximately equivalent to the signal wires extending from the upstream driver IC to the adjacent driver IC in the voltage supply direction downstream. The driver IC calculates the wire resistance by impressing a certain calculated voltage to one end of the wire resistance calculation wire, and then detects the voltage on the other end, calculates the amounts of the drop in voltage level based on the calculated wire resistance, and outputs the power supply voltages increased by the calculated respective amounts of the voltage drop to the downstream driver IC. Accordingly, a display apparatus is provided for preventing a drop in the power supply voltages sequentially supplied, thereby inhibiting malfunctioning of the driver ICs, resulting in improved display quality.

7 Claims, 3 Drawing Sheets

DISPLAY APPARATUS

CROSS-REFERENCE TO RELATED APPLICATIONS

This application claims priority under 35 U.S.C. § 119(a) to Japanese Patent Application No. 2004-098901, filed Mar. 30, 2004, and whose contents are incorporated herein by reference.

BACKGROUND OF THE INVENTION

1. Field of the Invention

The present invention relates to a display apparatus configured in such manner that multiple driver Integrated Circuits (ICs) are connected to the periphery of a display panel such as a liquid crystal display panel for the purpose of supplying signal input terminals formed on its periphery with signals.

2. Description of the Prior Art

For some time now, the Tape Carrier Package type mounting structure (TCP) has been employed as a mounting structure to connect driver ICs to a liquid crystal display panel for the purpose of supplying signals to signal input terminals formed on the periphery of the liquid crystal display panel. The TCP is constituted by disposing on a flexible circuit board the driver ICs, signal input wires for supplying the driver ICs with external signals, and signal output wires for supplying the liquid crystal display panel with drive signals from the driver ICs. The external signals include image data, an analog power supply voltage used to drive the driver ICs, and gradation power supply voltages for a gradation display.

If a liquid crystal display apparatus of the TCP type is the active matrix type using TFTs (Thin Film Transistors), gate TCPs and source TCPs are connected to the periphery of the liquid crystal display panel for supplying gate signal lines and source signal lines of the liquid crystal display panel respectively with signals, and an external circuit board is connected to the respective TCPs for the purpose of supplying external signals. The signal input wires of the TCP are connected to output terminals of the external circuit board, and the external signals are supplied from the external circuit board to the driver IC. The signal output wires of the TCP are in turn connected to the signal input terminals of the liquid crystal display panel, and the drive signals are supplied from the driver ICs to the liquid crystal display panel.

However, since the external signals are directly inputted from the external circuit board to the respective TCPs, it is necessary to provide a very large number of wires on the external circuit board of the liquid crystal display apparatus of the TCP type, which consequently involves a complex manufacturing process and increased costs while decreasing the level of reliability.

In view of the aforementioned problems, a so-called signal transmission type has recently been introduced to replace the TCP type described above, and the signal transmission type sequentially transmits external signals which have been inputted to one TCP from an external circuit board, and to an adjacent TCP. The liquid crystal display apparatus of the signal transmission type is described in Japanese Laid-Open Patent Publication No. 2001-56481.

In the liquid crystal display apparatus of the signal transmission type, the TCP is constituted by disposing on a flexible circuit board, a driver IC, signal input wires which supply the driver IC with external signals, signal output wires which supply the liquid crystal display panel with drive signals from the driver IC, and relay wires which output external signals required for driving the liquid crystal display panel to an adjacent TCP. On the other hand, the TCPs are connected to the periphery of the liquid crystal display panel, while connection wires, which electrically connect two adjacent TCPs are laid out on the gap formed between these TCPs.

In the liquid crystal display apparatus of the signal transmission type, the external signals supplied from the external circuit board are inputted to a specific TCP. In the TCP to which the external signals are inputted, the necessary external signals are supplied to the driver IC via the signal input wires, while the drive signals are supplied from the driver IC to the liquid crystal display panel via the signal output wires. Moreover, in the TCP to which the external signals are inputted, a portion of the external signals is supplied to relay wires, and such external signals are then supplied to the signal input wires of the adjacent TCP via the connection wires on the liquid crystal display panel. Similarly, in the adjacent TCP, required external signals are inputted to the driver IC, and a portion of the external signals is supplied to an adjacent TCP via the relay wires and the connection wires.

Accordingly, the external signals from the external circuit board are inputted to the specific TCP and sequentially transmitted from this specific TCP to the adjacent TCPs in the liquid crystal display apparatus of the signal transmission type.

In contrast to the conventional liquid crystal display apparatus of the TCP type, it is possible to substantially reduce the number of wires required for inputting the external signals from the external circuit board to the TCPs in the case of the liquid crystal display apparatus of the signal transmission type, resulting in a decrease in manufacturing cost.

However, since the liquid crystal display apparatus of the signal transmission type sequentially transmits the external signals which are input to the specific TCP, to the adjacent TCPs, the signal wires used for transmitting the external signals necessarily become longer, leading to increased wire resistance. Moreover, since a large number of signal wires is required in the TCPs and the liquid crystal display panel to be used for the driver ICs and for driving the liquid crystal display panel, the space required to dispose the signal wires for transmitting the external signals is therefore restricted, making it impossible to increase the width and thickness of the signal wires, thereby leading to greater wire resistance. Further, the increase in resistance of the signal wires occasions a drop in voltage of the transmitted external signals, particularly a drop in the power supply voltages, causing the driver ICs to malfunction.

The drop in voltage level of the transmitted power supply voltages increases in the downstream transmission direction, resulting in a difference between the drive signals output in the upstream from the driver ICs to the liquid crystal display panel and that of the downstream, such that the gradation between the upstream and the downstream varies, even if the same gradation is intended for the display. Consequently, the increase in resistance of the signal wires causes the display quality of the liquid crystal display apparatus to deteriorate.

Although the placement and the shape of the signal wires formed on the TCPs in the crystal display apparatus described in Japanese Laid-Open Patent Publication No. 2001-56481 are devised in such manner as to decrease the resistance of the signal wires, such measures are not necessarily sufficient.

SUMMARY OF THE INVENTION

The present invention has been devised to address the abovementioned problems, and aims to provide a display apparatus which can prevent malfunctioning of driver ICs by inhibiting a drop in power supply voltages sequentially transmitted, so as to increase the display quality of the liquid crystal display.

According to the first aspect of the present invention, a display apparatus is configured in such manner that a plurality of driver circuits mounting a driver IC on a circuit board are connected to the periphery of a display panel, the adjacent driver circuits being connected to each other by connection wires formed on the display panel, while power supply voltages required for driving the driver ICs and the display panel are supplied from an external control circuit to at least one of the driver circuits, and the power supply voltages sequentially supplied from one of the driver circuits to the driver circuit adjacent thereto, where a wire resistance calculation wire is formed for the driver IC in the upstream voltage supply direction, and is approximately equivalent in length to that of the signal wires extending from such driver IC to the driver IC on the adjacent driver circuit and downstream in the voltage supply direction, while the upstream driver IC calculates the wire resistance by impressing a certain calculated voltage on one end of the wire resistance calculation wire, and then detects the voltage of the other end, calculates the drop in voltage level based on the calculated wire resistance, and outputs the power supply voltages increased by the calculated amounts of the voltage drop to the downstream driver circuit.

Preferably, in the display apparatus, the wire resistance calculation wire is formed to route from the circuit board constituting the driver circuit back to the same circuit board via the display panel.

Moreover, according to this aspect of the present invention, the driver IC preferably consists of power supply voltage input terminals to which the power supply voltages are inputted, a calculation voltage creation section that creates the calculation voltage used to calculate the wire resistance, a calculation voltage output terminal that outputs the calculation voltage supplied from the calculation voltage creation section to one end of the wire resistance calculation wire, a detection terminal to which the output voltage of the other end of the wire resistance calculation wire is inputted, a wire resistance calculation section that calculates the wire resistance based on the calculation voltage and the voltage detected on the detection terminal, power supply voltage adding sections that are supplied with the power supply voltages inputted from the respective power supply voltage input terminals, calculate the respective amounts of the drop in voltage level based on the calculated wire resistance, and add the calculated amounts of the voltage drop to the respective power supply voltages, and power supply voltage output terminals that output the power supply voltages supplied from the respective power supply voltage adding sections, while the power supply voltages preferably include an operation power supply voltage for the driver ICs and display power supply voltages for the display panel.

According to the second aspect of the present invention, the display apparatus is configured in such manner that a plurality of driver ICs are connected to the periphery of the display panel, the adjacent driver ICs being connected to each other by connection wires formed on the display panel, power supply voltages required for driving the driver ICs and the display panel are supplied from an external control circuit to at least one of the plurality of driver ICs, and the power supply voltages are sequentially supplied from one of the driver ICs to one of the adjacent driver ICs, where a wire resistance calculation wire is formed for the driver IC in the upstream voltage supply direction, and whose length is approximately equivalent to that of the signal wires extending from the driver IC to the adjacent driver IC in the downstream voltage supply direction, and the upstream driver IC calculates the wire resistance by impressing a certain calculated voltage on one end of the wire resistance calculation wire, and after detecting the voltage of the other end, calculates the amounts of the drop in voltage level based on the calculated wire resistance, and outputs the power supply voltages increased by the calculated amounts of the voltage drop to the downstream driver IC.

Moreover, according to this aspect of the present invention, the driver IC preferably consists of power supply voltage input terminals to which the power supply voltages are inputted, a calculation voltage creation section that creates the calculation voltage used to calculate the wire resistance, a calculation voltage output terminal that outputs the calculation voltage supplied from the calculation voltage creation section to one end of the wire resistance calculation wire, a detection terminal to which the output voltage of the other end of the wire resistance calculation wire is inputted, a wire resistance calculation section that calculates the wire resistance based on the calculation voltage and the voltage detected on the detection terminal, power supply voltage adding sections that are supplied with the power supply voltages inputted from the respective power supply voltage input terminals, calculate the respective amounts of the voltage drop based on the calculated wire resistance, and add the calculated amounts of the voltage drop to the respective power supply voltages, and power supply voltage output terminals that output the power supply voltages respectively supplied from the power supply voltage adding sections, while the power supply voltages preferably include an operation power supply voltage for the driver ICs and display power supply voltages for the display panel.

As with the display apparatus according to the first aspect of the present invention, the driver IC upstream in the voltage supply direction outputs the power supply voltages increased by the respective amounts of the voltage drop calculated by means of the wire resistance calculation wire to the driver circuit downstream in the voltage supply direction. The output power supply voltages are supplied to the driver IC of the downstream driver circuit via the signal wires on the circuit board constituting the driver circuit and the connection wires on the display panel.

Although the level of power supply voltages supplied to the downstream driver IC drops as a result of transmission over the wires, since the voltages have been increased by the respective amounts in voltage drop upon being outputted from the upstream driver IC, the power supply voltages reach the voltage level required for the driver IC to operate normally upon being supplied to the downstream driver IC. Consequently, since the proper levels of power supply voltages are respectively supplied to the downstream driver IC, it is possible to prevent the driver ICs from malfunctioning. With this configuration, the display apparatus can operate normally.

In the case of the above preferred aspect of the present invention, since the wire resistance calculation wire is formed to route from the circuit board in tape form constituting the driver circuit back to the same circuit board via the display panel, it is possible to form the wire resistance calculation wire under conditions almost equivalent to those of the signal wires extending from the upstream driver IC to the downstream driver IC. Accordingly, the wires between the upstream driver IC and the downstream driver IC are divided into three wire sections consisting of the wires on the circuit board of the upstream driver circuit, the connection wires on the display panel, and the wires on the circuit board of the downstream driver circuit. On the other hand, the wire resistance calculation wire is formed to route from the circuit board leading the driver circuit back to the same circuit board via the display panel, and is thus divided into three wire sections consisting of a first wire on the circuit board constituting the driver circuit, another wire on the display panel, and a second wire on the same circuit board.

Thus, the first wire, the wire on the display panel, and the second wire respectively correspond to the wires on the circuit board of the upstream driver circuit, the connection wires on the display panel, and the wires on the circuit board of the downstream driver circuit. It is thus possible to form the wire resistance calculation wire under conditions almost equivalent to those of the signal wires extending from the upstream driver IC to the downstream driver IC. Consequently, it is possible to obtain the precise amount of wire resistance and the respective levels of voltage drop of the signal wires extending from the upstream driver IC to the downstream driver IC.

As with the display apparatus according to the second aspect of the present invention, the driver IC in the upstream voltage supply direction outputs the power supply voltages increased by the respective amounts of the voltage drop calculated by means of the wire resistance calculation wire to the driver IC in the downstream voltage supply direction. The output power supply voltages are then supplied to the downstream driver IC via the connection wires. Although the level of power supply voltages supplied to the downstream driver IC drops as a result of transmission over the connection wires, since the voltages have been increased by the respective amounts in voltage drop upon being outputted from the upstream driver IC, the power supply voltages reach the voltage level required for the driver IC to operate normally upon being supplied to the downstream driver IC. Consequently, since the proper levels of power supply voltages are respectively supplied to the downstream driver IC, it is possible to prevent the driver ICs from malfunctioning. With this configuration, the display apparatus can operate normally.

Moreover, as with the display apparatus according to the second aspect of the present invention, the power supply voltages supplied from the adjacent upstream driver IC are inputted to the driver IC from the power supply voltage terminals via the connection wires. The driver IC carries out a predetermined operation to output the drive signals to the display panel based on the input power supply voltages. On the other hand, the driver IC outputs the calculation voltage created by the calculation voltage creation section from the calculation voltage output terminal to one end of the wire resistance calculation wire, and receives the voltage output from the other end of the wire resistance calculation wire via the detection terminal. The wire resistance calculation section then calculates the wire resistance based on the calculation voltage output and the detected voltage input from the detection terminal while the power supply voltage adding sections calculate the drop in voltage levels based on the calculated wire resistance, and thereafter the wire resistance calculation section increases the power supply voltages by the calculated respective amounts in voltage drop. The power supply voltages from the power supply voltage adding sections are then outputted from the power supply voltage output terminals and supplied to the adjacent downstream driver IC via the connection wires. With this configuration, it is possible to supply the downstream driver IC with the power supply voltages which are respectively increased by the drop in levels of voltage due to wire resistance.

As with the display apparatus according to the second aspect of the present invention, since it is possible to supply the proper levels of voltage required for the respective driver ICs to operate, it is possible to prevent malfunctioning of the driver ICs, thereby permitting the display apparatus to operate normally. Moreover, since the proper levels of display power supply voltages are supplied to the respective driver ICs, it is possible for the respective driver ICs to supply the display panel with the respective proper drive signals, thereby reducing the possibility of uneven display which may caused by variations in gradation, ultimately producing improved display quality of the display apparatus.

DETAILED DESCRIPTION OF THE PREFERRED EMBODIMENTS

Figure 1:
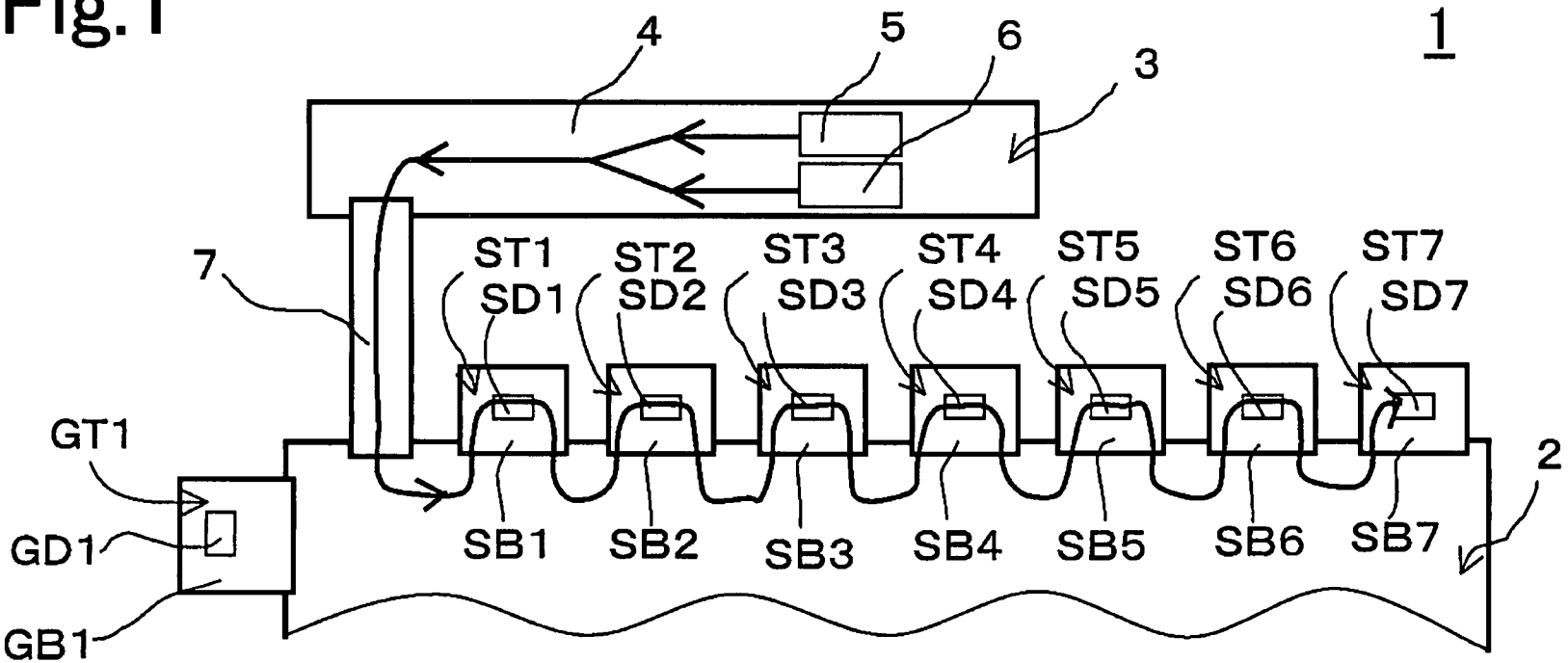
FIG. 1 is a plane view showing a schematic configuration of a liquid crystal display apparatus 1 according to the embodiment of the present invention.

FIG. 1 is a plane view showing a schematic configuration of a liquid crystal display apparatus 1 according to an embodiment of the present invention. The liquid crystal display apparatus 1 is configured by a liquid crystal display panel 2, and a control circuit 3 and multiple driver circuits ST1 to ST7, and GT1 disposed on the periphery of the liquid crystal display panel 2.

The liquid crystal display panel 2 is the active matrix type using Thin Film Transistors (TFT), for example. The active matrix type liquid crystal display panel using TFTs is constituted by interposing a liquid crystal layer between an active matrix substrate, which includes TFTs serving as switching elements corresponding to multiple pixel electrodes arranged in matrix form upon a transparent substrate such as a glass plate, and an opposing substrate, which includes a single sheet of common electrode formed approximately upon the entire surface of the transparent substrate.

The active matrix substrate is constituted by forming multiple gate signal lines parallel to each other and multiple source signal lines orthogonal to the gate signal lines and simultaneously parallel to each other upon the transparent substrate, and forming the pixel electrode and the TFT within respective rectangular areas formed and sectioned by the gate signal lines and the source signal lines. The drain, gate, and source of the TFT are connected to the pixel electrode, the gate signal line, and the source signal line, respectively. The gate signal line, which serves as an input terminal, is formed in such manner that one end thereof is extended to the periphery of one side of the transparent substrate. The source signal line, which also serves as an input terminal, is formed in such manner that one end thereof is extended to the periphery of one side of the transparent substrate. Thus, since the gate signal lines and the source signal lines are formed in the respective directions orthogonal to each other as described above, the periphery on the side on which the input terminals of the gate signal lines are formed and the periphery on the side on which the input terminals of the source signal lines are formed, are disposed adjacent to each other on the transparent substrate, as shown in FIG. 1.

The source driver circuits ST1 to ST7 (generally referred to as "ST") are connected to the respective input terminals of the source signal lines. The source driver circuits ST are constituted by a TCP. For example, the source driver circuit ST1 is constituted by mounting a driver IC SD1, and forming a large number of signal wires on a flexible circuit board SB1. The signal wires include multiple source signal output wires, which are used to supply the input terminals of the source signal lines with source signals (display voltages to be impressed on the pixels) output from the driver IC SD1. The source driver circuit ST1 and the liquid crystal display panel 2 are connected to each other by means of thermocompression bonding with an anisotropic conductive film interposed therebetween so that the source signal output wires and the input terminals of the source signal lines are electrically connected. The configuration of the other source driver circuits ST2 to ST7 and the manner in which they are connected to the liquid crystal display panel 2 are similar to those of the source driver circuit ST1.

The gate driver circuit GT1 is connected to the input terminals of the gate signal lines. Although only one gate driver circuit GT1 is shown in FIG. 1, multiple gate driver circuits are actually connected. The gate driver circuit GT1 is constituted by a TCP, and specifically, by mounting a driver IC GD1, and simultaneously disposing a large number of signal wires upon a flexible circuit board GB1. The signal wires include multiple gate signal output wires, which are used to supply the input terminals of the gate signal lines with gate signals (voltages to turn on/off the respective TFTs) output from the driver IC GD1. The gate driver circuit GT1 and the liquid crystal display panel 2 are connected each other by means of thermocompression bonding with an anisotropic conductive film interposed therebetween so that the gate signal output wires and the input terminals of the gate signal lines are electrically connected. The configuration of the other gate driver circuits (not shown) and the manner in which they are connected to the liquid crystal display panel 2 are similar to those of the gate driver circuit GT1.

In this way, the multiple driver circuits ST1 to ST7 and GT1 are connected to the periphery of the liquid crystal display panel 2. These driver circuits ST1 to ST7 and GT1 operate according to various power supply voltages, image data, and control signals supplied by a control circuit 3. The control circuit 3 is constituted by disposing a control IC 5, a power supply circuit 6, and a large number of signal wires on a circuit board 4. The control circuit 3 is connected to the liquid crystal display panel 2 via a signal supply Flexible Printed Circuit (FPC) board 7. The control IC 5 outputs the image data displayed on the liquid crystal display panel 2, the control signals used to control the driver circuits ST1 to ST7, and GT1, and the like. The power supply circuit 6 generates and outputs the various power supply voltages, such as an analog power supply voltage serving as an operation power supply of the driver ICs SD1 to SD7, and GD1, and gradation power supply voltages used for the gradation display on the liquid crystal display panel 2.

The various signals including the image data, control signals, and various power supply voltages, which are outputted from the control circuit 3, are supplied to the liquid crystal display panel 2 via the signal supply FPC 7. Connection wires used to connect the signal supply FPC 7 and the source driver circuit ST1 and gate driver circuit GT1 as well as connection wires used to connect the adjacent driver circuits with each other are disposed on the periphery of the liquid crystal display panel 2. With this configuration, the various signals supplied from the control circuit 3 are transmitted from the source driver circuit ST1 sequentially to the adjacent source driver circuits ST2 to ST7, as shown in FIG. 1. The various signals supplied from the control circuit 3 are also transmitted from the gate driver circuit GT1 sequentially to the adjacent gate driver circuits, which are not illustrated in FIG. 1, as in the case of the source driver circuits ST.

In the present embodiment of the liquid crystal display apparatus 1 configured as described above, a wire resistance calculation wire is formed for the driver IC SDi (i=1 to 6), which is approximately equivalent in the type of material, shape, length, width and thickness to that of the signal wires extending from the IC driver SDi for the source driver circuit STi upstream in the power supply voltage supply direction to the driver IC SDi+1 for the adjacent source driver circuit STi+1 downstream in the power supply voltage supply direction. The reference to "equivalent" herein also specifically implies approximately the same quality of wire resistance, which does not necessarily imply similarity in the type of material, length, width, and thickness.

The upstream driver IC SDi calculates the wire resistance by impressing a calculation voltage to one end of the wire resistance calculation wire, and after detecting the voltage on the other end, calculates the amounts of the voltage drop based on the calculated wire resistance, and outputs the power supply voltages increased by the respective calculated amounts of voltage drop to the downstream driver circuit STi+1.

A description will now be given of the wire resistance calculation wire and the driver IC SDi.

Figure 2:
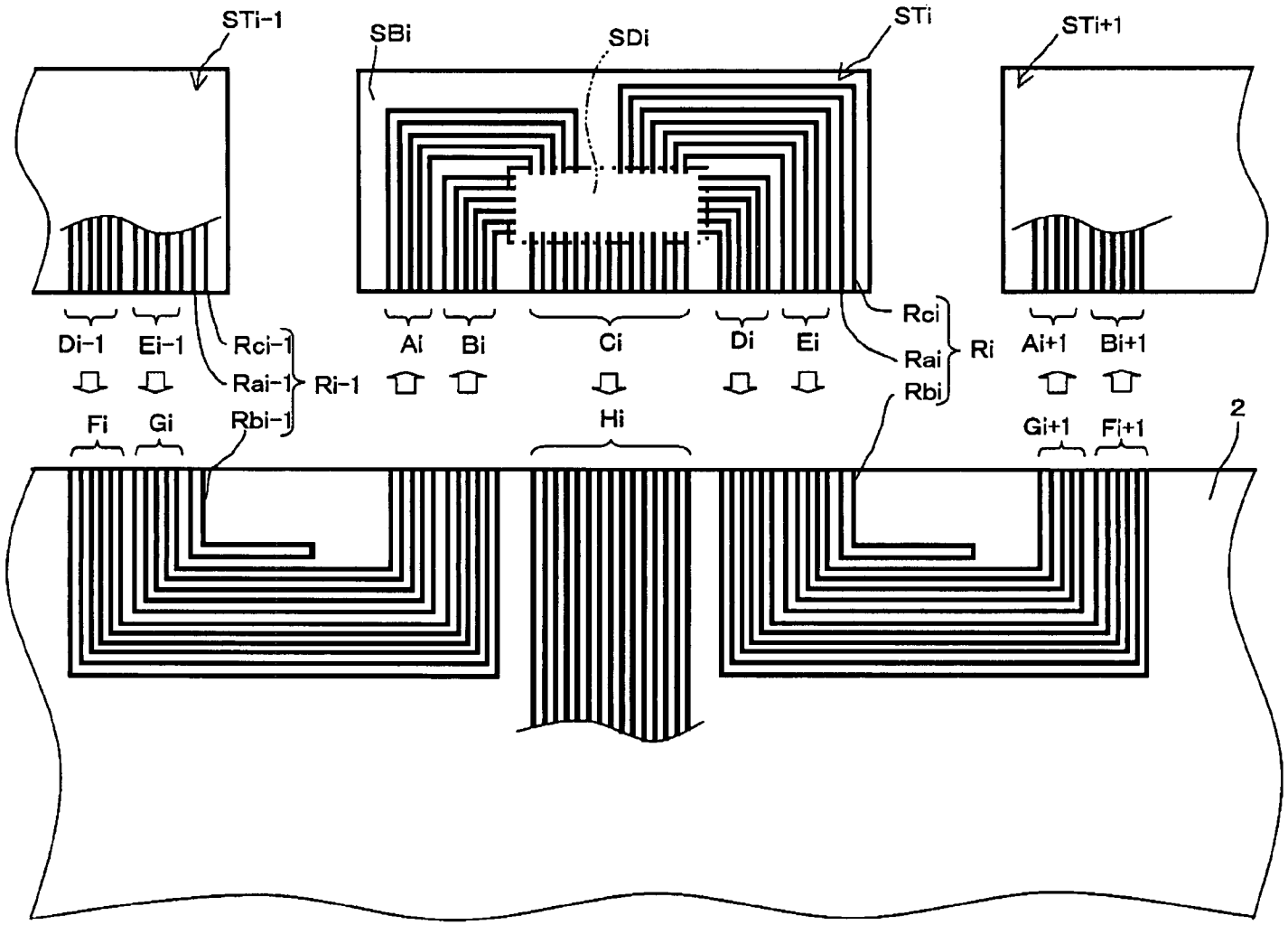
FIG. 2 is a plane view showing connections between a liquid crystal display panel 2 and a source driver circuit STi constituting the liquid crystal display apparatus 1.

FIG. 2 is a plane view describing the connection between the liquid crystal display panel 2 and the source driver circuit STi. The source driver circuit STi is constituted by mounting the driver IC SDi, and disposing a large number of signal wire groups Ai, Bi, Ci, Di, and Ei, and signal wires Rai and Rci on a rectangular flexible circuit board SBi. Note that although the signal wire groups Ai, Bi, Ci, Di, and Ei and the signal wires Rai and Rci are actually mounted on the front surface (rear side) of the flexible circuit board SBi opposite the liquid crystal display panel 2, the signal wires are merely illustrated as being disposed on the rear side (front side) of the flexible circuit board SBi opposite the liquid crystal display panel 2 (front side) in FIG. 2 to facilitate comprehension, while the location for mounting the driver IC SDi is marked by a box marked and drawn in double-dashed lines.

The power supply voltage input wire group Ai, the control signal input wire group Bi, the source signal output wire group Ci, the control signal output wire group Di, and the power supply voltage output wire group Ei are disposed on the flexible circuit board SBi. Likewise, the calculation voltage output wire Rai and the detected voltage input wire Rci, both of which constitute the wire resistance calculation wire Ri, are disposed on the flexible circuit board SBi.

One of the two long edges of the flexible circuit board SBi serves as a connection section used to connect with the liquid crystal display panel 2. The power supply voltage input wire group Ai is formed to extend from the connection section to the power supply voltage input terminals of the driver IC SDi. The control signal input wire group Bi is formed to extend from the connection section to the control signal input terminals of the driver IC SDi. The source signal output wire group Ci is formed to extend from the source signal output terminals of the driver IC SDi to the connection section. The control signal output wire group Di is formed to extend from the control signal output terminals of the driver IC SDi to the connection section. The power supply voltage output wire group Ei is formed to extend from the power supply voltage output terminals of the driver IC SDi to the connection section. The calculation voltage output wire Rai is formed to extend from the calculation voltage output terminal of the driver IC SDi to the connection section. The detected voltage input wire Rci is formed to extend from the connection section to the detection terminal of the driver IC SDi.

On the other hand, a source signal input terminal group Hi formed by extending the source signal lines to the edge is disposed on the periphery of the liquid crystal display panel 2 as described above, while the source driver circuit STi is connected to the periphery of the liquid crystal display panel 2 in such a way that the source signal output wire group Ci of the flexible circuit board SBi and the source signal input terminal group Hi overlap and connect with each other.

Moreover, connection wire groups Fi and Gi used to connect the source driver circuit STi and the source driver circuit STi−1 which are adjacent to each other in the upstream signal transmission direction, are disposed on the periphery of the liquid crystal display panel 2, while connection wire groups Fi+1 and Gi+1 used to connect the source driver circuit STi and the source driver circuit STi+1 which are adjacent to each other in the downstream signal transmission direction, are also disposed on the periphery of the liquid crystal display panel 2.

The connection wire group Fi is used for the control signals, and is formed to extend from the connection section of the upstream source driver circuit STi−1 to the connection section of the source driver circuit STi. Specifically, the connection wire group Fi used for the control signals is approximately U shaped, extending from the position where it overlaps the control signal output wire group Di−1 of the upstream source driver circuit STi−1 to the position where it overlaps the control signal input wire group Bi of the source driver circuit STi.

The connection wire group Gi is used for the power supply voltages, and is formed to extend from the connection section of the upstream source driver circuit STi−1 to the connection section of the source driver circuit STi. Specifically, the connection wire group Gi for the power supply voltages is approximately U shaped extending from the position where it overlaps the power supply voltage output wire group Ei−1 of the upstream source driver circuit STi−1 to the position where it overlaps the power supply voltage input wire group Ai of the source driver circuit STi.

The connection wire group Fi+1 is also used for the control signals, and is formed to extend from the connection section of the source driver circuit STi to the connection section of the downstream source driver circuit STi+1. Specifically, the connection wire group Fi+1 for the control signals is approximately U shaped extending from the position where it overlaps the control signal output wire group Di of the source driver circuit STi to the position where it overlaps the control signal input wire group Bi+1 of the downstream source driver circuit STi+1.

The connection wire group Gi+1 is also used for the power supply voltages, and is formed to extend from the connection section of the source driver circuit STi to the connection section of the downstream source driver circuit STi+1. Specifically, the connection wire group Gi+1 for the power supply voltages is approximately U shaped extending from the position where it overlaps the power supply voltage output wire group Ei of the source driver circuit STi to the position where it overlaps the power supply voltage input wire group Ai+1 of the downstream source driver circuit STi+1.

Further, a panel side wire Rbi constituting the wire resistance calculation wire Ri is disposed on the periphery of the liquid crystal display panel 2, and is formed by routing it from the position where it overlaps the calculation voltage output wire Rai of the source driver circuit STi to the position where it overlaps the detected voltage input wire Rci of the source driver circuit STi over the periphery of the liquid crystal display panel 2.

The wire resistance calculation wire Ri is constituted by the calculation voltage output wire Rai, the panel side wire Rbi, and the detected voltage input wire Rci, and is made of the same material as, and has approximately the same length, width, and thickness as that of the signal wires extending from the driver IC SDi to the driver IC SDi+1 of the adjacent driver circuit STi+1 downstream in the power supply voltage supply direction.

The source driver circuit STi is connected to the periphery of the liquid crystal display panel 2 by forming the wire groups and wires as described above, and the control signals and power supply voltages output of the upstream source driver circuit STi−1 are thus supplied to the source driver circuit STi via the connection wire group Fi and the connection wire group Gi, respectively. The control signals and power supply voltages output by the source driver circuit STi are then supplied to the downstream source driver circuit STi+1 via the connection wire group Fi+1 and the connection wire group Gi+1, respectively.

The control signals sequentially transmitted in this way include an operation clock signal for the driver IC SDi and image data. The power supply voltages sequentially transmitted include an analog power supply voltage serving as operation power supply for analog circuits inside the driver IC SDi, and multiple gradation power supply voltages which differ in voltage from one another. One or two voltages are selected from the multiple gradation power supply voltages being carried out on the liquid crystal display panel 2, based on image data, and a predetermined voltage is supplied to the liquid crystal display panel 2 as the source signal by a ladder resistor within the driver IC SDi.

The driver IC SDi of the source driver circuit STi operates based on the supplied analog power supply voltage as its source of operation power supply, and carries out predetermined control processing based on the control signals such as the clock signal and display data, to output the source signals to the liquid crystal display panel 2.

The driver IC SDi calculates the wire resistance by outputting the calculation voltage to the one end of the wire resistance calculation wire Ri, and after detecting the voltage on the other end, calculates the amounts of the voltage drop based on the calculated wire resistance, and outputs the power supply voltages increased by the calculated respective amounts of the voltage drop to the downstream source driver circuit Sti+1. The output power supply voltages are then supplied to the driver IC on the downstream source driver circuit STi+1 through the power supply voltage output wire group Ei on the flexible circuit board SBi and the connection wire group Gi+1 for the power supply voltages on the liquid crystal display panel 2.

Figure 3:
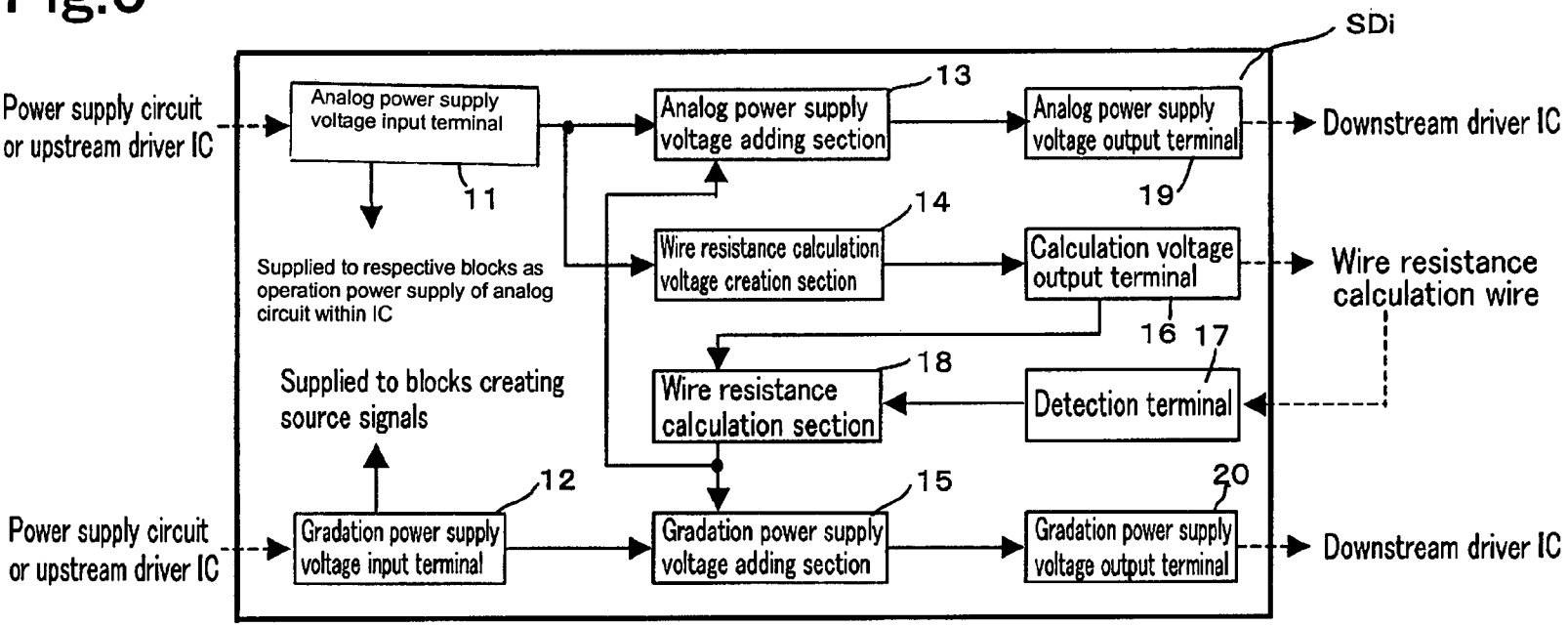
FIG. 3 is a block diagram showing the configuration of a driver IC SDi provided for the source driver circuit STi.

A description will now be given of a configuration example of the driver IC SDi. FIG. 3 is a block diagram showing the configuration of the driver IC SDi, illustrating the configuration for calculating the wire resistance as well as the configuration for adding the respective voltages to the power supply voltages, while omitting the configuration used for the display control of the liquid crystal display panel 2, which is primarily carried out by the driver IC SDi.

The analog power supply voltage supplied from the power supply circuit 6 of the control circuit 3 or the upstream driver IC SDi−1 is inputted to an analog power supply voltage input terminal 11, and the gradation power supply voltage is inputted to a gradation power supply voltage input terminal 12. The analog power supply voltage acting as the operation power supply of the analog circuits within the IC is supplied to multiple blocks including a signal creation circuit, which creates the source signals, as well as an analog power supply voltage adding section 13 and a wire resistance calculation voltage creation section 14. The gradation power supply voltage is also supplied to the signal creation circuit, which creates the source signals, as well as the gradation power supply voltage adding section 15.

The wire resistance calculation voltage creation section 14 creates the calculation voltage used to calculate the wire resistance, and supplies a calculation voltage output terminal 16 with the calculation voltage. One end of the wire resistance calculation wire Ri, more precisely one end of the calculation voltage output wire Rai is connected to the calculation voltage output terminal 16, and the calculation voltage is thus supplied to the wire resistance calculation wire Ri. The other end of the wire resistance calculation wire Ri, more precisely that end of the detected voltage input wire Rci is connected to a detection terminal 17, and the detected voltage output from the other end of the wire resistance calculation wire Ri is thus inputted to the detection terminal 17.

The detected voltage input to the detection terminal 17 is supplied to a wire resistance calculation section 18. The calculation voltage supplied to the calculation voltage output terminal 16 is also supplied to the wire resistance calculation section 18. The wire resistance calculation section 18 then obtains the difference between the calculation voltage and the detected voltage, and calculates the wire resistance based on the obtained difference. The calculated wire resistance is thus supplied to the analog power supply voltage adding section 13 and the gradation power supply voltage adding section 15.

The analog power supply voltage adding section 13 calculates the voltage dropped by the wire resistance (voltage drop) based on the supplied wire resistance, adds the calculated amount of the voltage drop to the analog power supply voltage supplied by the analog power supply voltage input terminal 11 (by increasing the analog power supply voltage by the amount of the voltage drop), and supplies an analog power supply voltage output terminal 19 with the analog power supply voltage added with (increased by) the amount of the voltage drop. The analog power supply voltage supplied to the analog power supply voltage output terminal 19 is then supplied to the driver IC SDi+1 of the downstream source driver circuit STi+1.

The gradation power supply voltage adding section 15 calculates the voltage dropped by the wire resistance (voltage drop) based on the supplied wire resistance, adds the calculated amount of the voltage drop to the gradation power supply voltage supplied by the gradation power supply voltage input terminal 12, and supplies a gradation power supply voltage output terminal 20 with the gradation power supply voltage added with the amount of the voltage drop. The gradation power supply voltage supplied to the gradation power supply voltage output terminal 20 is then supplied to the driver IC SDi+1 of the downstream source driver circuit STi+1.

Note that since the driver IC SDi is supplied with multiple gradation power supply voltages which differ in voltage from one another as described above, a number of gradation power supply voltage input terminals 12, gradation power supply voltage adding sections 15, and gradation power supply voltage output terminals 20 corresponding to the respective gradation power supply voltages are actually provided, although only one of each of these components is illustrated in FIG. 3.

As described above, on the liquid crystal display apparatus 1, the driver IC SDi of the source driver circuit STi outputs the power supply voltages increased by the respective amounts of the voltage drop calculated by the wire resistance calculation wire Ri to the downstream source driver circuit STi+1. The output power supply voltages are supplied to the driver IC SDi+1 of the downstream driver circuit STi+1 via the power supply voltage output wire group Ei on the flexible circuit board SBi constituting the source driver circuit STi, the connection wire group Gi for the power supply voltages on the liquid crystal display panel 2, and the power supply voltage input wire group Ai+1 of the downstream driver circuit STi+1.

Although the power supply voltages supplied to the downstream driver IC SDi+1 drop as a result of transmission over the wires, since the voltages have been increased by the respective amounts of the voltage drop upon being outputted from the upstream driver IC SDi, the power supply voltages reach the level of voltage required for the driver IC to operate normally upon being supplied to the downstream driver IC SDi+1. Consequently, since the proper power supply voltages are respectively supplied to the downstream driver IC SDi+1, it is possible to prevent the driver ICs SD from malfunctioning. With this configuration, the liquid crystal display apparatus 1 can operate normally.

Moreover, since the wire resistance calculation wire Ri routing from the flexible circuit board SBi constituting the source driver circuit STi back to the same flexible circuit board SBi via the liquid crystal display panel 2 is disposed on the liquid crystal display apparatus 1, it is possible for the wire resistance calculation wire Ri to be formed under conditions almost equivalent to those of the signal wires extending from the driver IC SDi to the downstream driver IC SDi+1.

Namely, the power supply voltage wires between the driver IC SDi and the downstream driver IC SDi+1 are divided into three wire sections consisting of the power supply voltage output wire group Ei on the flexible circuit board SBi of the source driver circuit STi, the connection wire group Gi+1 for the power supply voltages on the liquid crystal display panel 2, and the power supply voltage input wire group Ai+1 on the flexible circuit board SBi+1 of the downstream source driver circuit STi+1. Since the wire resistance calculation wire Ri is also disposed to route from the flexible circuit board SBi constituting the source driver circuit STi back to the same flexible circuit board SBi via the liquid crystal display panel 2, the wire resistance calculation wire Ri is divided into three wire sections consisting of the calculation voltage output wire Rai, which is the first wire on the flexible circuit board SBi, the panel side wire Rbi on the liquid crystal display panel 2, and the detected voltage input wire Rci, which is the second wire on the flexible circuit board SBi.

The calculation voltage output wire Rai corresponds to the power supply voltage output wire group Ei on the flexible circuit board SBi of the source driver circuit STi, while the panel side wire Rbi on the liquid crystal display panel 2 corresponds to the connection wire group Gi+1 for the power supply voltages on the liquid crystal display panel 2, and the detected voltage input wire Rci corresponds to the power supply voltage input wire group Ai+1 on the flexible circuit board SBi of the downstream source driver circuit STi+1. It is thus possible to form the wire resistance calculation wire Ri under conditions almost equivalent to those of the signal wires extending from the driver IC SDi to the downstream driver IC SDi+1. Consequently, it is possible to precisely obtain the level of wire resistance and the respective amounts of the voltage drop of the signal wires extending from the driver IC SDi to the downstream driver IC SDi+1.

The length, width, thickness and material of the signal wires located between the driver IC SDi and the downstream driver IC SDi+1 are determined in advance during the design stage of the liquid crystal display apparatus 1. It is thus possible to independently produce a signal wire by employing a method whereby its length, width, thickness and material can be determined during the design stage, by which the wire resistance is measured, and the obtained wire resistance is stored in memory, the amounts of the voltage drop are calculated using the stored wire resistance, and the calculated amounts of the voltage drop are respectively added to the analog power supply voltage and the gradation power supply voltages. However, this method is not preferable because of certain problems that arise, as discussed below.

First, since the liquid crystal display panel 2 and the source driver circuit ST are connected to each other by means of the thermocompression bonding with the anisotropic conductive film interposed therebetween, there is generated a resistance due to the compression bonding at the connected section. Consequently, it is difficult to determine the impact of the resistance due to compression bonding if the signal wire produced independently is used, and therefore, wire resistance cannot be estimated accurately if the signal wire produced independently is used.

Secondly, although the length, width, thickness and material of the signal wire are determined in advance during the design stage of the liquid crystal display apparatus 1, the length, width, and thickness of the signal wire respectively bring about tolerances during actual manufacturing of the liquid crystal display panel 2 and the source driver circuit ST, resulting in variations. Consequently, the signal wire produced independently and the signal wire disposed on the liquid crystal display apparatus 1 as actually manufactured are not completely equivalent in length, width, and thickness, and therefore, wire resistance cannot be measured accurately.

Thirdly, if the wire resistance measured in advance were to be stored in memory, the disposition of the memory must be additionally considered. For instance, if the memory is provided outside the driver IC, it is necessary to add a new component, resulting in increased cost. Alternatively, if the memory is provided within the driver IC, it would also be necessary to add a new component, likewise resulting in increased cost. On the other hand, if the existing memory within the driver IC is used to avoid such cost, if the standard of the liquid crystal display changes, its wire resistance changes accordingly, such that the generality of the driver IC consequently disappears, making it necessary to produce a new driver IC each time the standard of the liquid crystal display apparatus 1 changes, resulting in increased cost just the same.

As will be appreciated from the above, the method of producing the wire resistance calculation wire Ri on the liquid crystal display apparatus 1 according to the present embodiment, and then measuring the wire resistance to be used, actually allows the determination of wire resistance accurately, thereby properly compensating the voltage drop of the power supply voltages due to the signal wires.

On the liquid crystal display apparatus 1, the analog power supply voltage for the operation of the driver IC SDi, and the gradation power supply voltages supplied to the liquid crystal display panel 2 are increased by the respective amounts of the voltage drop due to the wire resistance, and are then supplied to the driver IC SDi. Consequently, since the proper power supply voltage for the operation is supplied to the respective driver ICs SD, it is possible to prevent the driver ICs SD from malfunctioning. Moreover, since the proper gradation power supply voltages are supplied to the respective driver ICs SD, it is possible for the respective driver ICs SD to supply the liquid crystal display panel 2 with the respective proper source signals, thereby reducing the possibility of uneven display due to variations in gradation, thereby resulting in improved display quality of the liquid crystal display apparatus 1.

Although a description has been made only with respect to the source driver circuit ST, the embodiment of the invention may be similarly applied to the gate driver circuit GT. Moreover, the embodiment is not limited to the liquid crystal display apparatus 1, and may be similarly applied to a display apparatus structured in such manner that multiple driver circuits are arranged on the periphery of the display panel. Further, the embodiment may be similarly applied to a liquid crystal display apparatus of the COG (Chip On Glass) type where driver ICs are directly mounted on the periphery (glass substrate) of the liquid crystal display panel.

Further still, a wire resistance calculation wire may be formed on the control circuit 3 as in the case of the source driver circuit ST, to output the power supply voltages increased by the respective amounts of the voltage drop upon being supplied from the power supply circuit 6.

Further yet, although a singular signal supply FPC 7 is connected to the corner of the liquid crystal display panel 2 in the configuration example shown in FIG. 1, another signal supply FPC may be connected at the midpoint of the liquid crystal display panel 2.

Even further, although the analog power supply voltage adding section 13 is illustrated in FIG. 3, the display apparatus may be configured without the analog power supply voltage adding section 13. In this case, the analog power supply voltage may be set high enough, as it will not cause malfunctioning that may be occasioned by the voltage drop due to wire resistance.

What is claimed is:

1. A display apparatus configured in such manner that a plurality of adjacent driver circuits, each mounting a driver IC on a circuit board are connected to the periphery of a display panel, said adjacent driver circuits being connected to each other by a connection wire formed on the said display panel, while a power supply voltage required for driving the said driver ICs and the said display panel is supplied from an external control circuit to at least one of the said driver circuits, and sequentially supplied from one of the said driver circuits to the driver circuit adjacent thereto, wherein:

a wire resistance calculation wire is formed for the said driver IC upstream in the voltage supply direction, and is approximately equivalent to a signal wire extending downstream from the said driver IC to the said driver IC on the driver circuit adjacent thereto in the voltage supply direction, and the said upstream driver IC calculates the wire resistance by impressing a certain calculated voltage on one end of the said wire resistance calculation wire, and then detects the voltage of the other end, calculates the drop in voltage level based on the calculated wire resistance, and outputs the power supply voltage increased by the calculated amount of the voltage drop to the said downstream driver circuit.

2. The display apparatus according to claim 1, wherein the said wire resistance calculation wire is formed to route from said circuit board in a tape form constituting the said driver circuit back to the said circuit board again via the said display panel.

3. The display apparatus according to claim 1, wherein each said driver IC comprises an power supply voltage input terminal to which the power supply voltage is inputted, a calculation voltage creation section that creates the calculation voltage used to calculate the wire resistance, a calculation voltage output terminal that outputs the calculation voltage supplied from the said calculation voltage creation section to one end of the said wire resistance calculation wire, a detection terminal to which the output voltage of the other end of the said wire resistance calculation wire is inputted, a wire resistance calculation section that calculates the wire resistance based on the calculation voltage and the voltage detected on the said detection terminal, a power supply voltage adding section that is supplied with the power supply voltage inputted from the said power supply voltage input terminal, calculates the amount of the drop in voltage level based on the calculated wire resistance, and adds the calculated amount of the voltage drop to the power supply voltage, and a power supply voltage output terminal that outputs the power supply voltage supplied by the said power supply voltage adding section.

4. The display apparatus according to claim 1, wherein the power supply voltage includes an operation power supply voltage for each of the said driver ICs, and a display power supply voltage for the said display panel.

5. A display apparatus configured in such manner that a plurality of adjacent driver circuits, each mounting a driver IC on a circuit board, are connected to the periphery of a display panel, said adjacent driver circuits being connected to each other by a connection wire formed on the said display panel, while a power supply voltage required for driving the said driver ICs and the said display panel is supplied from an external control circuit to at least one of the said driver ICs, and sequentially supplied from one of the said driver ICs to the driver IC adjacent thereto, wherein:

a wire resistance calculation wire is formed for the said driver IC upstream in the voltage supply direction, and is approximately equivalent in length to that of a signal wire extending downstream from the said upstream driver IC to the driver IC adjacent thereto in the voltage supply direction, and the said upstream driver IC calculates the wire resistance by impressing a certain calculated voltage on one end of the said wire resistance calculation wire, and after detecting the voltage of the other end, calculates the drop in voltage level based on the calculated wire resistance, and outputs the power supply voltage increased by the calculated amount of the voltage drop to the said downstream driver IC.

6. The display apparatus according to claim 5, wherein each said driver IC comprises a power supply voltage input terminal to which the power supply voltage is inputted, a calculation voltage creation section that creates the calculation voltage used to calculate the wire resistance, a calculation voltage output terminal that outputs the calculation voltage supplied from said calculation voltage creation section to one end of the said wire resistance calculation wire, a detection terminal to which the output voltage of the other end of the said wire resistance calculation wire is inputted, a wire resistance calculation section that calculates the wire resistance based on the calculation voltage and the voltage detected on the said detection terminal, a power supply voltage adding section that is supplied with the power supply voltage inputted from the said power supply voltage input terminal, calculates the amount of the voltage drop based on the calculated wire resistance, and adds the amount of the voltage drop to the power supply voltage, and a power supply voltage output terminal that outputs the power supply voltage supplied from the said power supply voltage adding section.

7. The display apparatus according to claim 6, wherein the power supply voltage includes an operation power supply voltage for each of the said driver ICs, and a display power supply voltage for the said display panel.

* * * * *